US006523389B1

(12) United States Patent
Girdner

(10) Patent No.: US 6,523,389 B1
(45) Date of Patent: Feb. 25, 2003

(54) SEGMENTED PIPE-BENDING DIE

(76) Inventor: Daniel D. Girdner, 330 Bismark Rd., Jackson, NJ (US) 08527

( * ) Notice: Subject to any disclaimer, the term of this patent is extended or adjusted under 35 U.S.C. 154(b) by 0 days.

(21) Appl. No.: 10/112,358

(22) Filed: Mar. 30, 2002

(51) Int. Cl.[7] ..... B21D 37/02
(52) U.S. Cl. ..... 72/413; 72/478; 72/380
(58) Field of Search ..... 72/413, 416, 478, 72/380

(56) References Cited

U.S. PATENT DOCUMENTS

| | | | | | |
|---|---|---|---|---|---|
| 484,264 | A | * | 10/1892 | Trist | 72/413 |
| 1,272,531 | A | * | 7/1918 | Riley | 72/413 |
| 2,267,774 | A | * | 12/1941 | Wall | 72/478 |
| 2,966,934 | A | * | 1/1961 | Huet | 72/413 |
| 3,417,601 | A | * | 12/1968 | Werner | 72/478 |
| 3,426,569 | A | * | 2/1969 | Brauer et al. | 72/413 |
| 6,035,691 | A | * | 3/2000 | Lin et al. | 72/413 |

* cited by examiner

*Primary Examiner*—David Jones
(74) *Attorney, Agent, or Firm*—Robert M. Skolnik

(57) ABSTRACT

A segmented pipe-bending die produces curvature across the pipe contacting surface of the die by varying the radii of the semi-circular pipe bending segments, or by offsetting the position of adjacent segments having equal or varying radii semi-circular apertures, laterally, longitudinally, or both. The pipe-bending die is formed from a plurality of metallic segments, which are affixed together. Each metallic segment of the die has a semi-circular pipe contacting surface portion. The radius of a plurality of the semi-circular pipe-contacting surface of each segment differs in length so that the pipe-contacting surface has a predetermined curvature formed by the resultant difference in height of the pipe contacting surface portions of each segment.

11 Claims, 4 Drawing Sheets

SEGMENTED PIPE-BENDING DIE

BACKGROUND OF THE INVENTION

1. Field of the Invention

The present invention relates to a segmented or laminated pipe-bending die.

2. Description of the Related Art

Pipe bending of the type described herein is required for large diameter pipe used in pipeline construction. Typically, machines for bending pipe having a diameter of 6" or greater use the pipe-bending die of the present invention. Machines for bending the pipe may be of the types shown in Toderick U.S. Pat. No. 3,009,507 or Heaman U.S. Pat. No. 5,123,272. Toderick discloses a tractor-mounted side-boom. Heaman shows a self-propelled press. Other machines known as vertical pipe bending machines are also known for bending pipe on-site in pipeline construction.

All the pipe bending machines require at least one shoe or die which contacts the pipe to be bent to establish the configuration of the desired degree of pipe bend. Once the shoe or die is in place, other portions of the pipe are forced in opposition to the force exerted on the pipe by the die.

Pipe bending and metal working dies of the prior art are disclosed in the following United States Patents.

Toderick, U.S. Pat. No. 3,009,507 discloses a segmented pipe-bending shoe. Each segment is mounted on a common spring 64.

Amano, et al., U.S. Pat. No. 4,089,198 disclose a metal-working die having a retractable portion 17 formed of a number of links to adjust the working length of portion 17.

Green, U.S. Pat. No. 4,362,044 shows a pipe-bending die where pipe contact with the die is on surfaces 20, 25.

Heaman, U.S. Pat. No. 5,123,272 discloses a pipe-bending machine where the dies are divided into a number of transverse segments, which are moveable to distribute the load among all the segments. Each segment may have hydraulic support. A flexible membrane may cover the segments.

Codatto, U.S. Pat. No. 5,642,639 shows a segmented holder, which varies the thickness of each segment.

De Rossi, et al, U.S. Pat. No. 5,775,156 describe an equation for selecting the width of the segments of a sheet bending die.

Walczak U.S. Pat. No. 5,878,619 teaches a punch and die assembly for sheet metal processing. The die is formed of a number of plates.

Sarkisian, et al, U.S. Pat. No. 5,950,481 describe a segmented die for use in a forging press. Each of the segments has a different shape and is advanced along with movemeht of a work piece so that a relative large work piece can be shaped on a relatively small press.

Another prior art die is constructed by forging steel in a mold to produce a one-piece die with a surface of the required shape.

SUMMARY OF THE INVENTION

The present invention provides a pipe-bending die formed from a plurality of metallic segments, which are affixed together. Each metallic segment of the die has a semi-circular pipe contacting surface portion. The radius of the semi-circular pipe-contacting surface of each segment differs in length so that the pipe-contacting surface has a predetermined curvature formed by the resultant difference in height of the pipe contacting surface portions of each segment. In addition, each segment may be made so that the bottom surfaces of the segmented die adjacent the opening of the semi-circular pipe contacting surface are formed with the same degree of curvature as that formed in the pipe contacting surface. The segmented construction of the die has demonstrated simplicity, as it has no moving parts. Such a segmented construction also has proven to be easier to construct and therefore less costly, than the die formed by molten steel poured into a mold.

The segmented die of the present invention is used in the vertical pipe bending machines offered by a number of suppliers namely Darby Equipment Company, Evans Pipeline Construction Company, and DMI Industrial, Inc., and CRC Pipeline Equipment all of Tulsa Okla.

Such vertical pipe bending machines are generally illustrated in FIGS. 1–2 of the present application. These machines operate by moving a section of pipe into the machine and positioning it under the die and the point where the bend is to commence. A hydraulic cylinder called a pin-up cylinder forces a wedge under a shoe known as a pin-up shoe to raise it to engage the pipe. Another hydraulic cylinder is connected to the stifiback pipe supporting shoe to pull the stiffback up pushing the pipe against the die. With the die acting as the fulcrum, this hydraulic cylinder pushes the end of the stiffback shoe up, bending the pipe. After each bending operation, the pipe is moved through the machine an increment and the operation repeated until the desired angle of bend is achieved. The pipe is always moved toward the pin-up shoe when bending, thus keeping a straight portion of the pipe in the stiffback shoe during bending. Each size of pipe required a different size bending die. Each size of pipe, smaller than the maximum the machine will handle, requires a set of liners in addition to the die. The liners fit into the stiffback shoe and the pin-up shoe.

Two embodiments of the segmented die are disclosed. In both embodiments, the segments have a semi-circular shaped pipe-contacting surface. In one embodiment, each segment has a semi-circular shaped outer edge. In another embodiment, each segment has an outer edge formed of a flat top portion and two angled portions forming lateral extensions, which extend outwardly from the opening of each semi-circle. These lateral extensions provide a die with exterior dimensions that fit within a pipe-bending machine over a range of different pipe diameters. Both embodiments permit flexibility in die construction. In other applications, the pipe-bending surfaces may be concave or convex and the placement of the segments may be offset axially or laterally to produce different shapes in the pipes being bent.

A principal object and advantage of the invention is the provision of a segmented pipe-bending die.

Another object and advantage of the invention is the provision of a segmented pipe-bending die, which has no moving parts.

Still another object and advantage of the invention is the provision of a segmented pipe-bending die that is formed of segments each having a semi-circular pipe-contacting surface.

A still further object and advantage of the invention is the provision of a segmented pipe-bending die where each semi-circular segmented has a radius of different length.

Another object and advantage of the invention is the provision of a segmented pipe-bending die that may be more easily fabricated and at lower cost than forged steel molded dies.

The above objects are realized with a segmented pipe bending die comprised of a plurality of segments each having a semi-circular pipe contacting portion with adjacent segments having different length radii to produce a curved pipe contacting surface along all the segments forming the die.

The foregoing, as well as further objects and advantages of the invention will become apparent to those skilled in the art from a review of the following detailed description of my invention, reference being made to the accompanying drawings.

DETAILED DESCRIPTION OF THE PREFERRED EMBODIMENT

Figure 1:
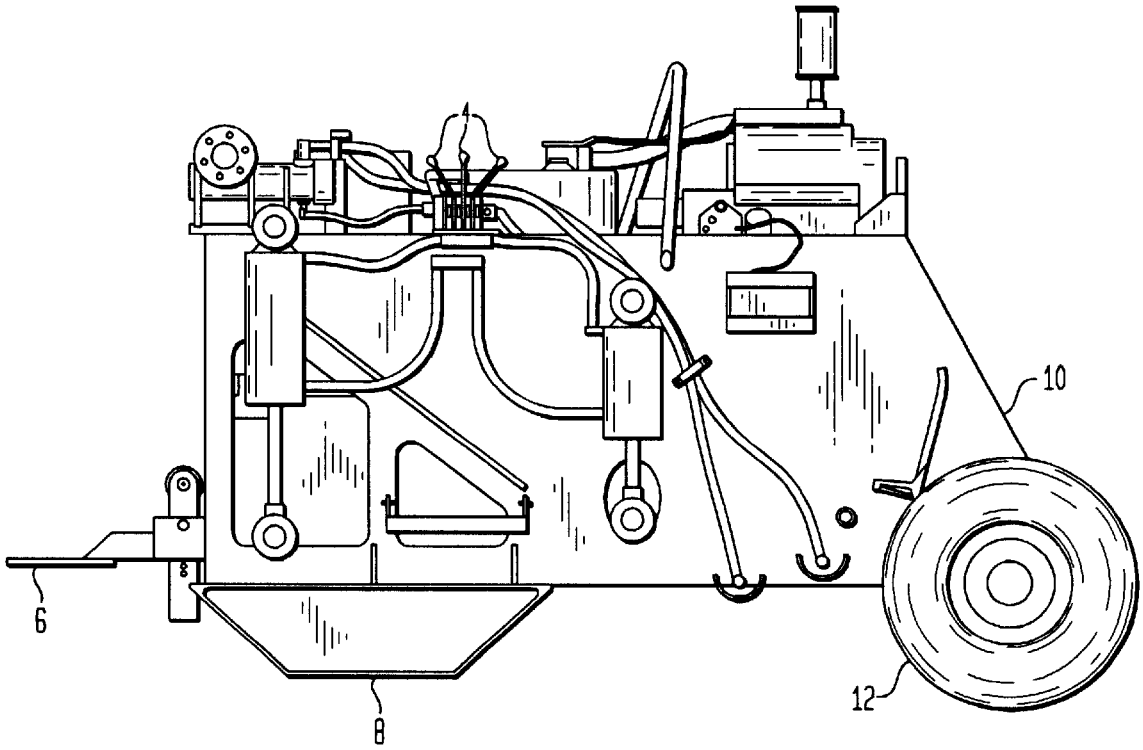
FIG. 1 is a side view of a typical pipe-bending machine with which the segmented die of the present invention may be utilized.
Figure 2:
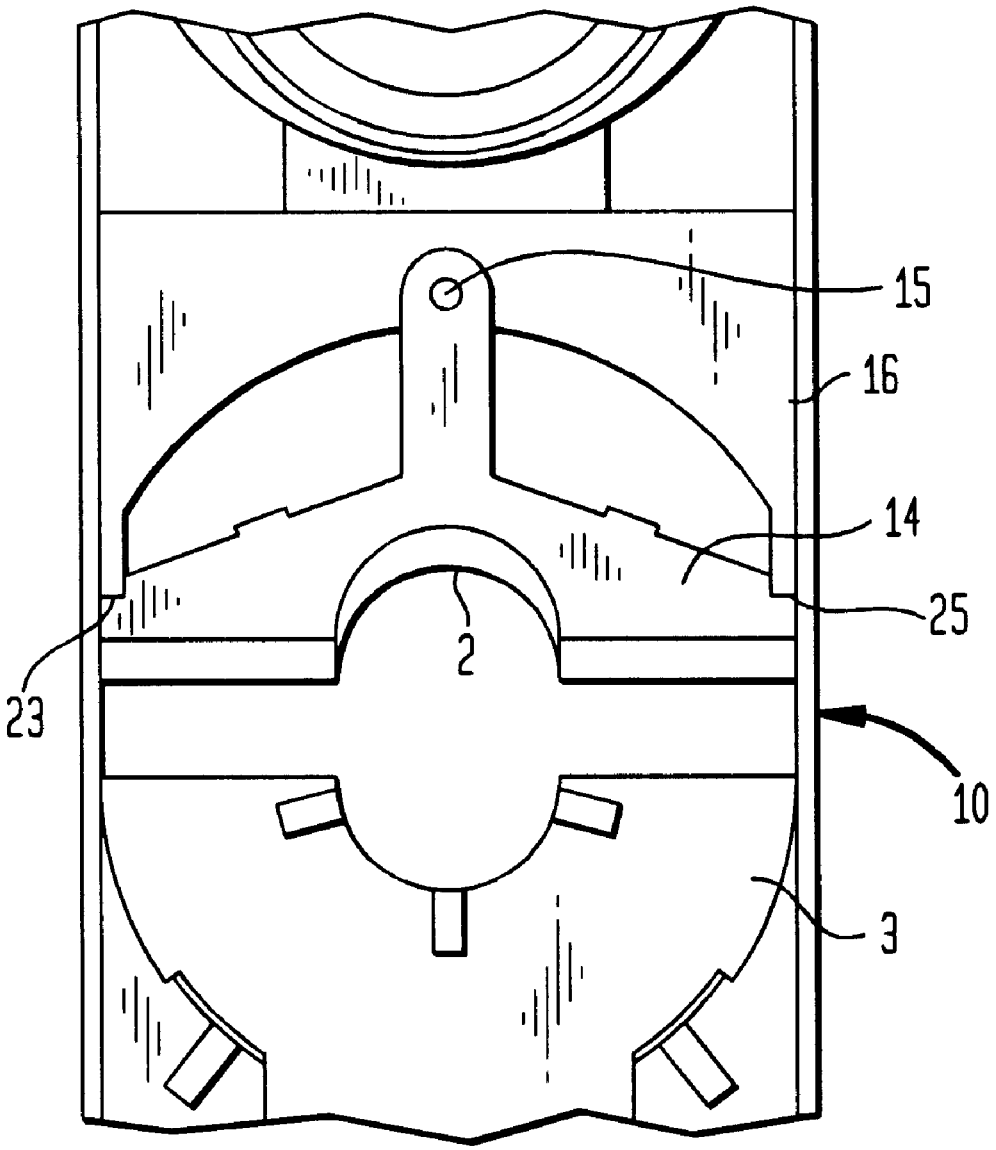
FIG. 2 is an end view of the output side of the machine of FIG. 1.

FIGS. 1–2 show a known vertical pipe-bending machine used for pipe bending on location in pipeline construction. The machine is shown generally at 10 and has a wheeled end 12 and another section supported by skid 8. The machine 10 is moved into place by a crawler tractor picking up the machine at fixture 6. The pipe bending operations of the machine 10 is controlled by levers 4. The pipe-bending machine has a pipe bending shoe or die 14 (which may be either of the segmented dies described in this application) mounted therein for contacting the top of a pipe section to be bent. As is known, pin-up shoe 3 holds an end portion of the pipe section. The machine 10 is a model PB 6-20 manufactured by the aforementioned CRC Pipeline Equipment.

The die 14 is affixed by stem 15 to a support portion 16 of machine 10. The die 14 has a curved pipe-engaging portion 2 formed therein.

FIGS. 3–6 show segmented pipe bending dies formed of steel segments having different shaped outer edges but having pipe-contacting portions formed of semi-circles of different radii. The radii of each segment has been empirically determined. Dies have been fabricated in accordance with the following example.

Example-A segmented die of a length of 36" was formed of 48 metallic segments each of a width of ¾". The distance from a level placed on the smallest radii center segments was 1½" at the largest end segments. The difference in such distance from segment to segment was 1/16". The center four smallest segments were formed having equal radii. The resultant die was tested on several pipes in the machine of FIGS. 1–2 and operated satisfactorily.

Figure 3:
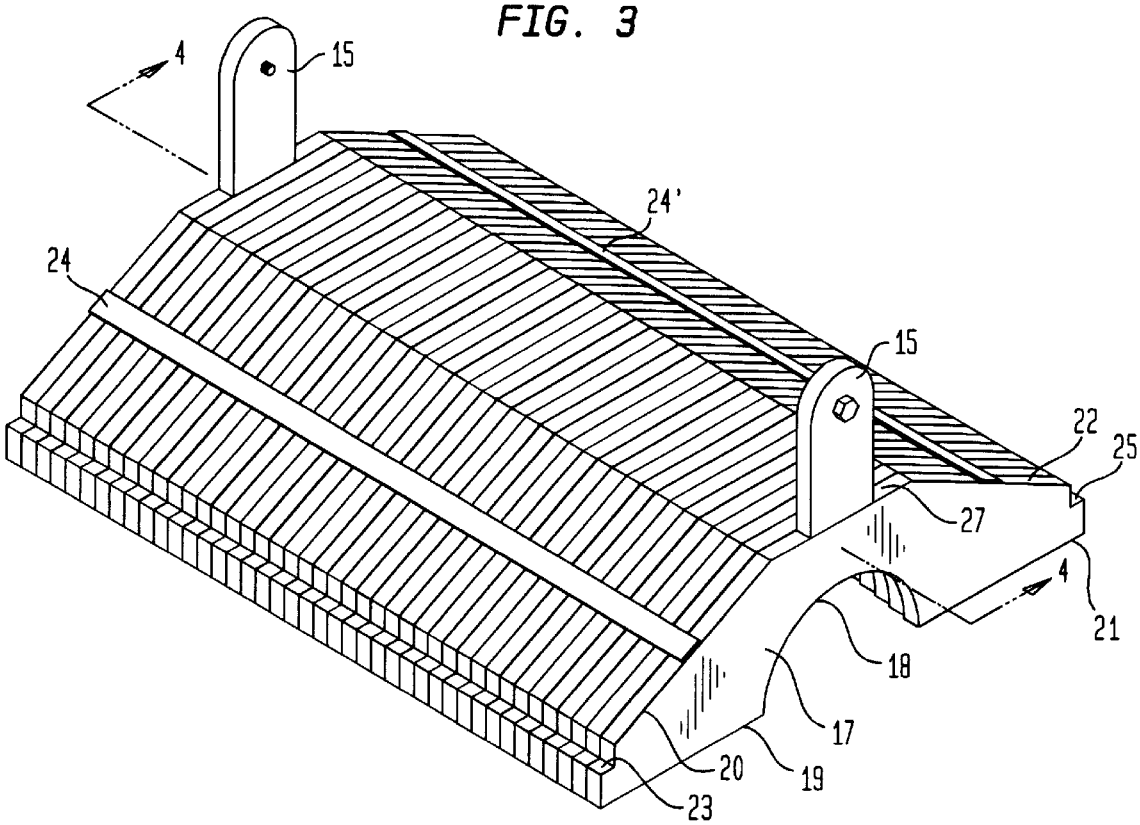
FIG. 3 is a perspective view of a first embodiment of a segmented die.
Figure 4:
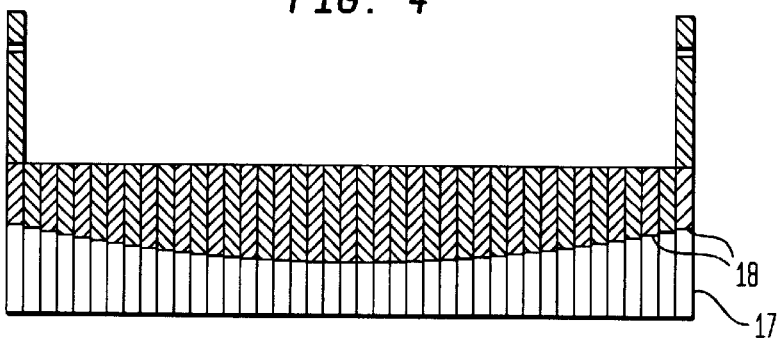
FIG. 4 is a sectional view of the die of FIG. 3 taken along the lines 4—4 of FIG. 3.

In the embodiment of FIGS. 3–4, each segment has the shape of element 17. A semi-circular aperture 18 is formed in the element 17 and lateral wings 19 and 21 extend from the mouth of the aperture 18. Notches 23 and 25 are formed at the ends of wings 19 and 21, respectively. Tapered edges 20 and 22 extend from the flat top edge 27 towards notches 23 and 25, respectively. One or more bars 24, 24' may be used to hold all the segments in place by welding each segment to the bars. The bars 24, 24' may be mounted as desired on the flat top edge, on the tapered edges as shown, or on the underside of the lateral wings (not shown). Alternatively the segments may be welded together, or a combination of segment-to-segment welds and supporting bars may be employed.

As shown in FIG. 2, notches 23 and 25 mate with corresponding extension portions of the portion 16 of machine 10 to support the die in the machine.

Figure 5:
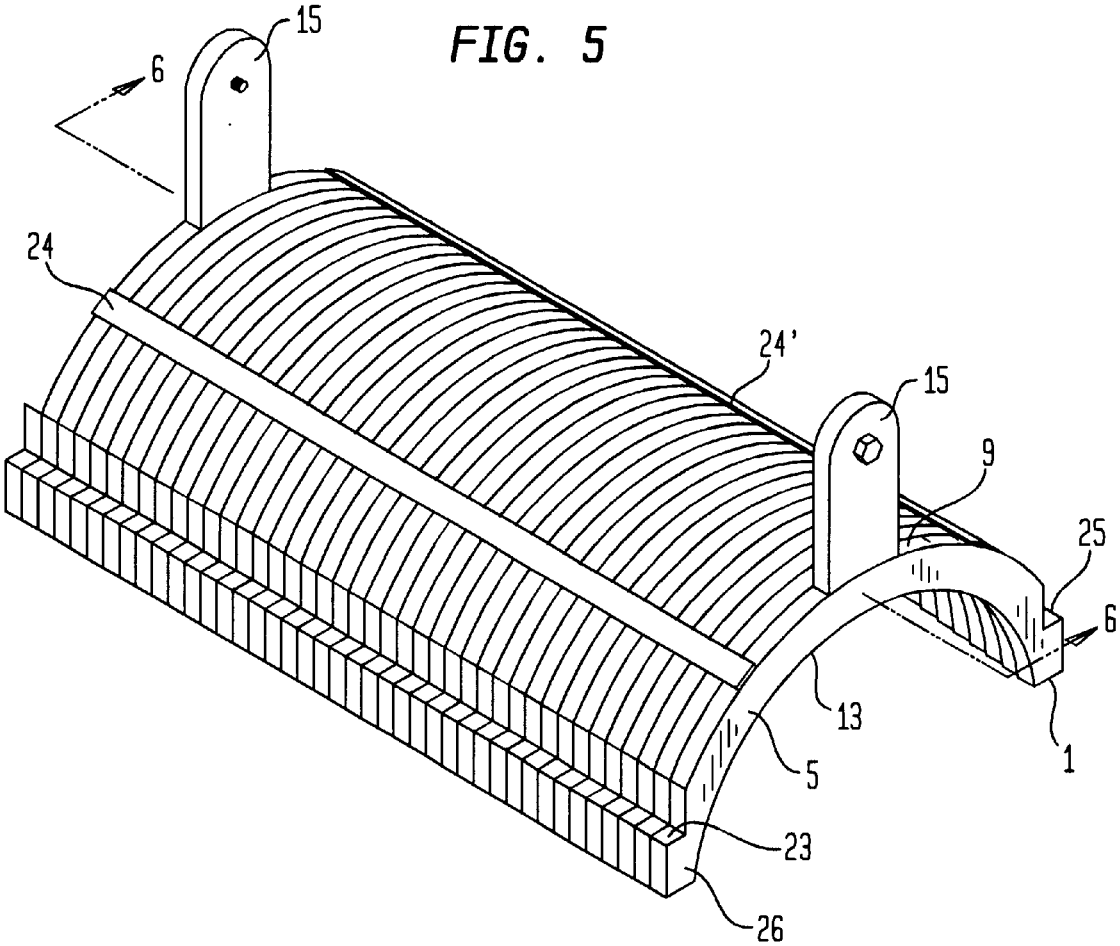
FIG. 5 is a perspective view of second embodiment of a segmented die.
Figure 6:
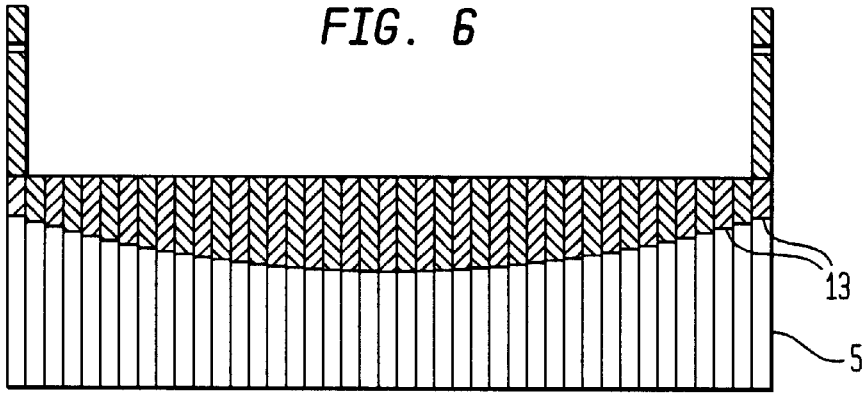
FIG. 6 is a sectional view of the die of FIG. 5 taken along the lines 6—6 of FIG. 5.

In the embodiment of FIGS. 5–6, each segment has the shape of segment 5, namely, a semi-circular aperture having a curved top surface 9 and a pipe-contacting inner surface 13. Notches 23 and 25, which are the same as the notches in FIG. 3, are formed in each segment adjacent the ends 26 and 1, of the segment 5, respectively. The segments 5 may be welded together. Alternatively, supporting bars 24 and 24' may be welded to each segment to hold all the segments together in the same manner as described in connection with FIGS. 3–4. Both bars and segment welding may also be employed.

The segmented construction of the embodiments of FIGS. 3–6 show dies constructed to bend pipes in one direction. The elements of FIGS. 3–6 are linearly aligned. The segments when linearly aligned are formed to produce a pipe-engaging curved surface by varying the radius of adjacent segments.

For other applications, it is also recognized that the segmented construction of the present invention permits dies to be constructed to bend pipes in other directions by laterally offsetting the segments one from the other vertically or horizontally produce other curvatures in the die. The alignment of the segments and the shape of the segments produce pipe-engaging curved surfaces by varying the position of identically shaped segments, or by varying the radius of curvature of adjacent segments.

Further modifications to the apparatus of the invention may be made without departing from the spirit and scope of the invention; accordingly, what is sought to be protected is set forth in the appended claims.

I claim:

1. A pipe-bending die comprising, a plurality of segments affixed together, each of said segments being composed of a semi-circular opening having a radius which differs in length from the radius of adjacent segments and connecting means for affixing each of said segments sequentially to each other.

2. The pipe-bending die of claim 1 wherein each of said segments has a semi-circular pipe bending inner surface and a semi-circular outer edge attached to said connecting means.

3. The pipe-bending die of claim 2 further including at least one supporting notch formed in said semi-circular outer edge.

4. The pipe-bending die of claim 3 further including attaching means connected to said segments for attaching said segments together.

5. The pipe-bending die of claim 4 wherein said attaching means is a bar welded to said segments.

6. The pipe-bending die of claim 1 wherein each of said segments has a semi-circular pipe-bending inner surface, a flat edge portion adjacent to said semi-circular pipe bending inner surface, wing portions extending from said semi-circular portion, each of said wing portions having a supporting notch formed therein, and a tapered edge extending upwardly from said notch to said flat edge portion.

7. The pipe-bending die of claim 6 further including attaching means connected to each of said segments for holding said segments together.

8. The pipe-bending die of claim 7 wherein said attaching means includes at least one bar welded to said segments.

9. A pipe-bending die comprising a plurality of segments affixed together, each of said segments having a semi-circular pipe-bending surface formed therein, a plurality of said semi-circular pipe-bending surfaces of adjacent segments having radii of different lengths to produce a curvature in the pipe bending surface of said pipe-bending die.

10. The pipe-bending die of claim 9 further including attaching means connected to each of said segments for connecting and supporting all of said segments.

11. The method of manufacturing a pipe-bending die comprising the steps of forming a plurality of metallic segments each having a semi-circular pipe contacting inner surface, the radius of a plurality of said semi-circular pipe contacting surfaces varying from segment to segment and attaching said segments together with the largest radius segments being located at either end and the smallest radius segments being located centrally of said die.

* * * * *